United States Patent [19]

Fogleman et al.

[11] Patent Number: 4,669,394

[45] Date of Patent: Jun. 2, 1987

[54] SAFES

[76] Inventors: H. Frank Fogleman, 9955 Lemonwood La., San Diego, Calif. 92124; Harold N. Druihet, 1033 Naranca Ave., El Cajon, Calif. 92021

[21] Appl. No.: 716,331

[22] Filed: Mar. 26, 1985

[51] Int. Cl.[4] ..... E05G 1/04

[52] U.S. Cl. ..... 109/59 T; 70/278

[58] Field of Search ..... 109/59 T, 59 R, 58; 70/278, 279, 320, 332; 52/658, 657; 16/381, 386; 49/381, 388; 220/62; 312/100, 138 R

[56] References Cited

U.S. PATENT DOCUMENTS

| | | | |
|---|---|---|---|
| 517,261 | 3/1894 | Clark | 109/59 R |
| 1,447,462 | 3/1923 | Butscher et al. | 109/59 |
| 1,582,541 | 4/1926 | Ringer | 220/62 |
| 2,438,108 | 3/1948 | Barler et al. | 220/62 |
| 3,812,403 | 5/1974 | Gartner | 70/278 |
| 4,190,929 | 3/1980 | Palka | 16/381 |
| 4,381,877 | 5/1983 | Stark | 312/138 R |

*Primary Examiner*—James L. Ridgill, Jr.

[57] ABSTRACT

The safe has a five-sided box wtih a door mounted thereon to swing between opened and closed positions. A latch locks the door when in a closed position. An electronic locking arrangement responds to a digital access code for operating the latch in a rapid manner. A combination dial controlled mechanical lock is also employed for entering a combination code into the mechanical lock for operating the latch independently of the electronic latching arrangement. The five-sided box is made from pieces of sheet metal, one of which is folded along two spaced parallel lines to form three sides, to provide the box with few seams. Special hinges are provided inside the box for mounting the door swingably. The hinges are concealed and inaccessible when the door is closed, and can enable the door to be unhinged quickly by authorized persons to replace the safe door for repair or maintenance purposes.

22 Claims, 14 Drawing Figures

7
5
5
20
32
24
OPEN
LOCK
26
126
50
22
21
4
4
7

28
34
36B
38B
X
46
42
36A
39
39A
36
32
38
C
38A
29
30
50
Y
39C
38C
40
51
43
36C
44
31

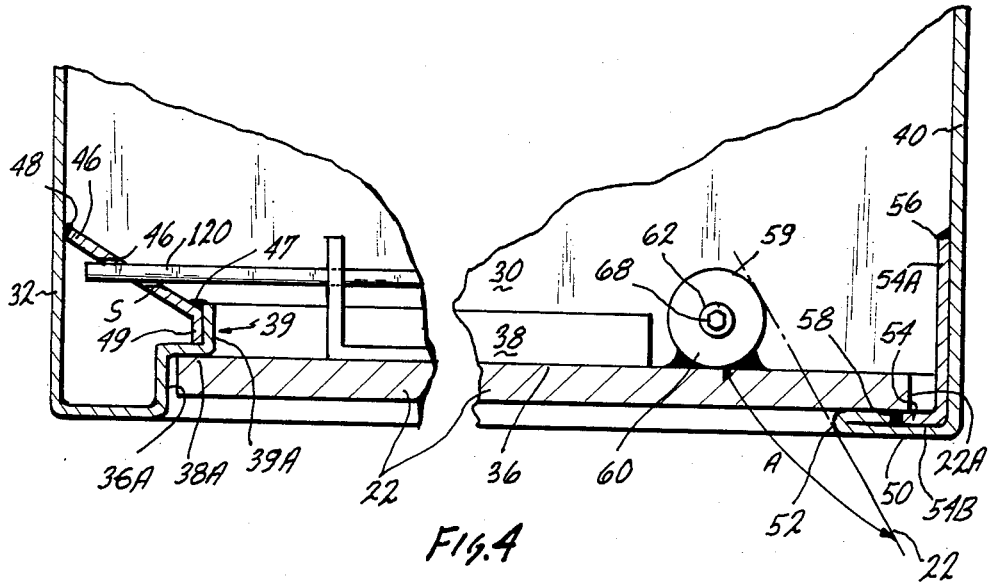
Fig. 4
Fig. 5
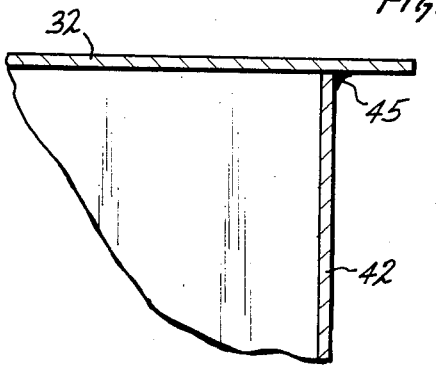

78
80
86
84
66
85
88
22
82
98
100
114
118
72
110
71
104
70
106
76
27
108
62
68
59
89
60
38
74
A
116
36
21
25
120
112
22

SAFES

TECHNICAL FIELD

This invention relates to safes and, more particularly, to rapid access safes.

Reference is made by co-pending commonly-assigned application entitled "ELECTRICALLY CONTROLLED LOCKING APPARATUS AND SAFE UTILIZING SAME", U.S. Ser. No. 723,547, filed Apr. 15, 1985, which shows some of the details of the invention which are broadly described herein.

BACKGROUND ART

There have been various types and kinds of publicly used safes for the storage of valuables. Such safes have been employed, for example, in hotels and motels, as "in-room" safes, for use by the guests.

While such safes may have been generally satisfactory for some applications, it would be highly desirable to have such a safe that may be suitable for in-room use, as well as for personal or office use. Such a safe should be not only constructed in such a manner to be very secure, but also relatively inexpensive to manufacture. In this regard, even though it must be relatively inexpensive, such as by tools used to invade forceably, or otherwise, the protected interior of the safe. Prior known publicly used safes were expensive to manufacture, because of the labor intensive manufacturing techniques employed in an attempt to provide for the necessary security.

Additionally, the safe should have rapid access capabilities, as well as alternate access, in a convenient and reliable manner. In this regard, it would be highly desirable to have such a safe that employs an electronically controlled locking mechanism, to enable the door to be released quickly and conveniently by entering an access code in a key pad mounted on the front of the safe door. Additionally, should the user forget the access code, or the electronic control inadvertently malfunctions, a convenient and reliable alternative access mode should be provided.

It is of further importance to the present invention that, especially when the safe is intended for public use, it be adapted for fast and efficient repair or maintenance at the site by authorized personnel. In this regard, it is highly desirable to have a safe that can be repaired or replaced quickly so as not to inconvenience the user unduly.

DISCLOSURE OF INVENTION

Accordingly, an object of the invention is to provide a new and improved safe, which is suitable for in-room, personal or office use, and which is not only relatively inexpensive to manufacture, but also is constructed in a secure manner.

Another object is to provide a safe with both an electronically controlled locking arrangement which may be set to an access code selected by an authorized user and a mechanical lock which may be used to override the electronically controlled locking arrangement, in a convenient and reliable manner.

Still another object is to provide means for enabling quick and easy repair or maintenance of such a safe with little or no inconvenience to the user.

In keeping with an aspect of this invention, these and other objects are accomplished by a box made of folded sheet metal and having very few seams.

The safe has a five-sided box with a door mounted thereon to swing between opened and closed positions. A latch locks the door when in a closed position. An electronic locking arrangement responds to a digital access code for operating the latch in a rapid manner. A combination dial controlled mechanical lock is also employed for entering a combination code into the mechanical lock for operating the latch independently of the electronic latching arrangement. The five-sided box is made from two pieces of sheet metal, one of which is folded along two spaced parallel lines to form three sides, to provide the box with few seams. Special hinges are provided inside the box for mounting the door swingably. The hinges are concealed and inaccessible when the door is closed, and can enable the door to be unhinged quickly by authorized persons to replace the safe door for repair or maintenance purposes.

As a result of the unique construction of the safe of the present invention, the integrity of the safe does not depend on its hinges. In this regard, should someone attempting to gain unauatorized access to the protected interior of the safe, somehow remove the hinge pins from the safe, such a person would be unable to open the door to the safe.

Moreover, according to the present invention, the door locking mechanism and controls therefor are mounted entirely on the protected inside of the door. Thus, it becomes a relatively uncomplicated matter for the authorized person to remove the entire door, together with the locking mechanisms and controls therefor, from the safe, for repair or maintenance purposes.

The inventive safe can, therefore, be opened by an authorized person by performing an access function with the electronic arrangement in a rapid manner, as more fully described in the foregoing pending patent application. Additionally, the electronic locking arrangement can be overridden by using the combination lock to open the safe.

All of the necessary parts for performing the locking functions are mounted on the back of the door to the safe. Therefore, to perform maintenance or repair, it is only necessary to replace the door with another like door, to enable the function of the safe to be resumed quickly without undue inconvenience to the user.

The construction of the box is relatively inexpensive due to the simple folding operation. Also, the resulting unit has very few seams, and thus, at the same time, is highly secure in that tampering is made much more difficult. Also, other construction features relate to reinforcement of the door opening to resist greatly any tampering efforts.

BRIEF DESCRIPTION OF DRAWINGS

The above-mentioned and other objects and features of this invention and the manner of attaining them will become apparent, and the invention itself will be best understood by reference to the following description of embodiments of the invention taken in conjunction with the accompanying drawings, wherein:

FIGS. 4 and 5 are cross-sectional fragmentary plan detail views of the box forming the safe, FIG. 4 being taken substantially on correspondingly numbered section lines in FIG. 1;

BEST MODE FOR CARRYING OUT THE INVENTION

Figure 1:
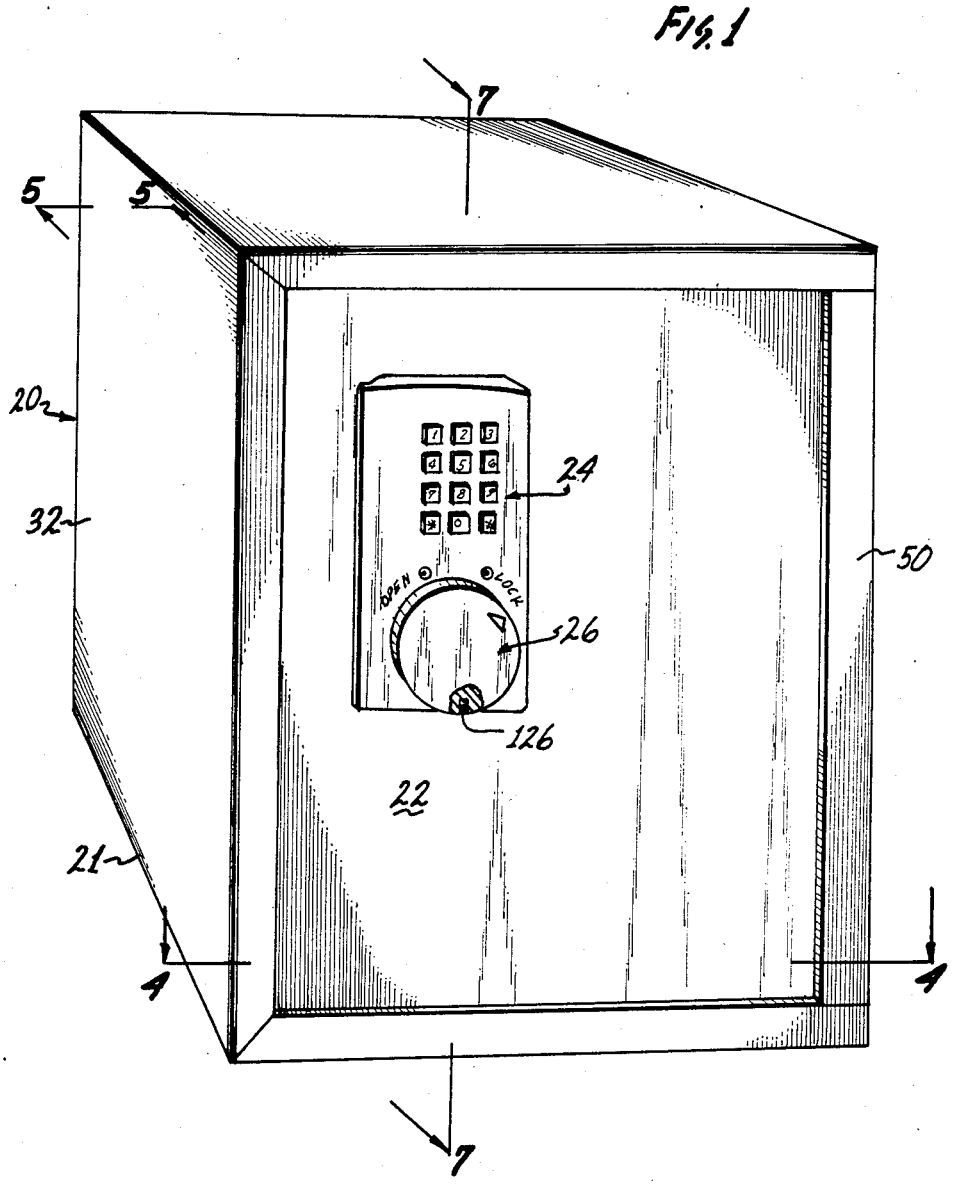
FIG. 1 is a pictorial view of the outside of a safe, which is constructed according to the present invention.

A safe 20 (FIG. 1) includes a closed box 21 having five sides, with a hinged door 22 mounted on the front of the box. The door 22 is hinged at the inside of the safe so that tampering or illegal "safe cracking" is much more difficult, if not possible. The front of the door has a key pad 24 which may be operated in a coded sequence to control an electronic locking control circuit 25 (FIG. 6) that unlocks the door as disclosed more fully in the aforementioned patent application.

Figure 10:
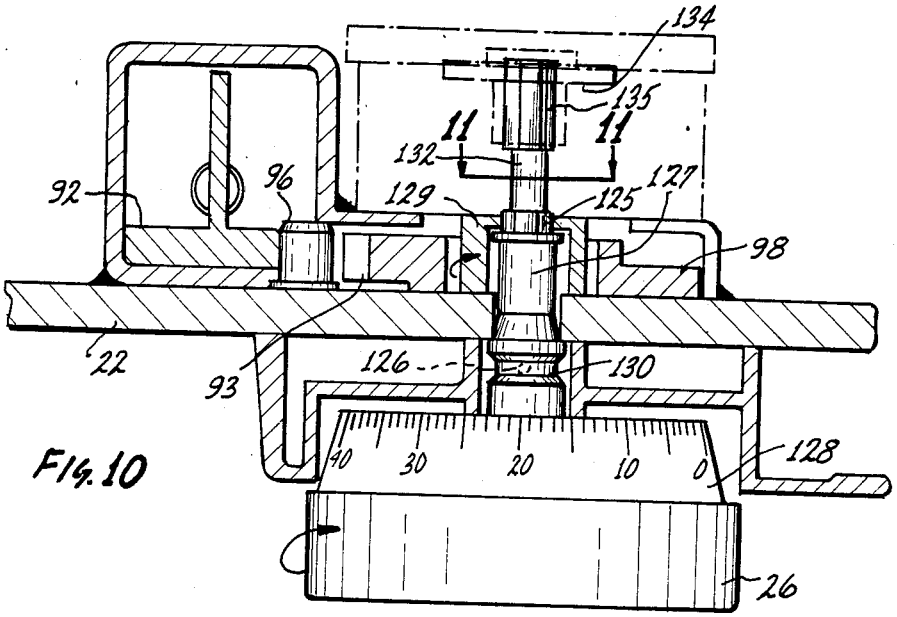
FIG. 10 is a sectional view of the mechanical, combination lock in a mechanical lock inhibiting position, taken substantially on line 10—10 of FIG. 9.

A mechanical, combination dial or knob 26 controls a mechanical lock 27 (FIG. 6) that may override the electronic circuit 25, and open the door 22 independently of the electronic circuit. The knob 26 is horizontally axially movable and is normally positioned in close proximity to the front of the door, in a depressed and lock control inhibiting state to conceal the numbers of a scale 128 (FIG. 10), on the knob. Alternatively, the knob can be rotated axially to unlatch or latch the door after the electronic lock control circuit is operated. Thus, the single knob 26 is used with both the mechanical lock 27 and the electronic control circuit 25.

Figure 2:
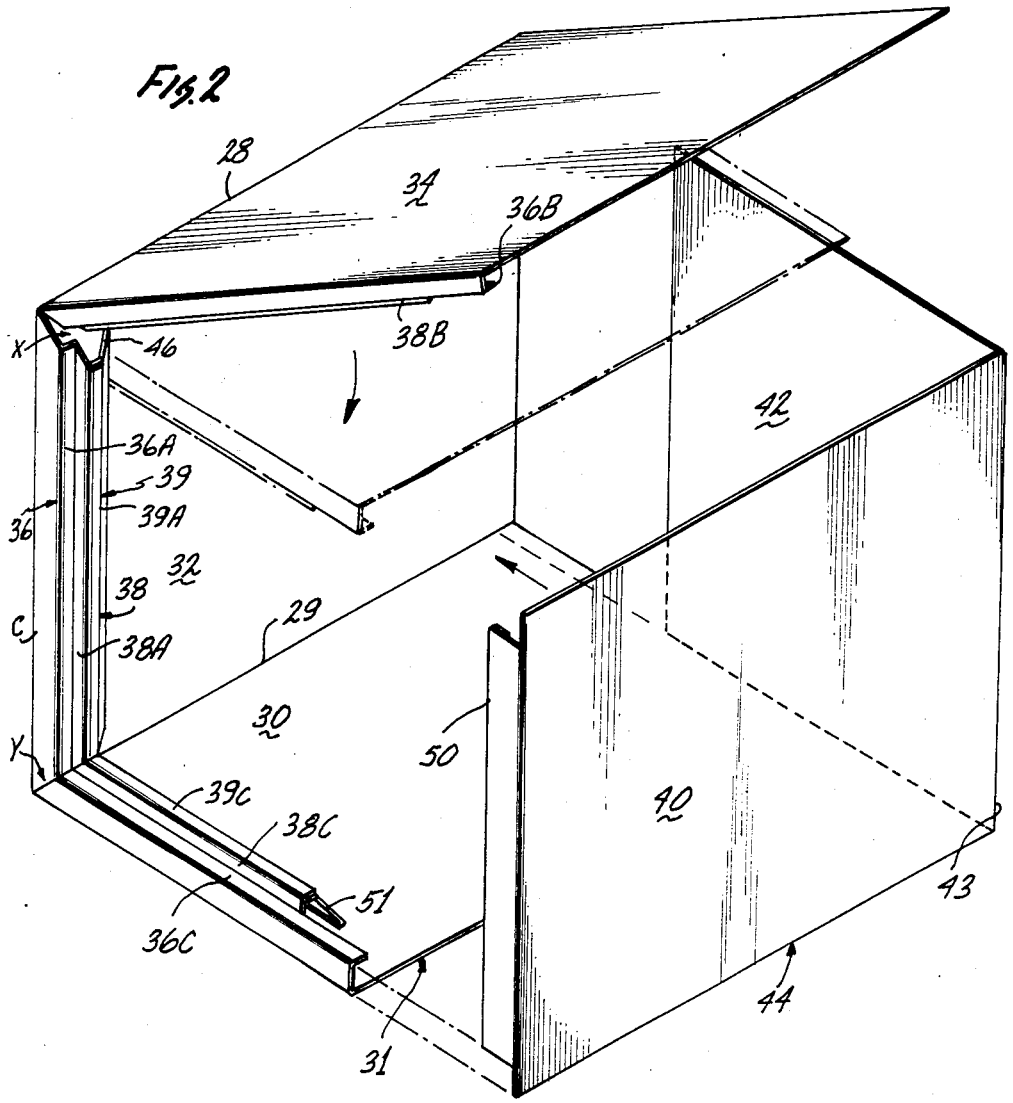
FIG. 2 is a pictorial view illustrating how the walls of the safe are constructed from sheet metal with a few number of seams between adjacent panels.

The safe housing construction is seen in FIG. 2 where a single sheet 31 of metal is folded along two spaced parallel lines 28 and 29 to form three sides, a bottom wall or floor 30, a left side wall 32, and a top wall 34. The front ends or marginal edges of these panels are folded to form a door frame 36 and door stop 38. These folds are made without requiring any seams or other structures that can be caught by a pry or other similar tool.

The right side wall 40, which abuts the hinged side of door 22 (FIG. 1), is integrally connected to a back wall 42 at a fold line 43 and are made from a single sheet 44 of metal. A bead of welding, such as the bead 45 (FIG. 5), extends along each of the edges where three panels 30, 32 and 34 come together and are joined to the back wall 42. Then, the bead is ground to provide a smooth and unbroken surface which prevents the use of a pry. This is shown in FIG. 5 where bead 45 appears at the edge where the left side wall 32 joins the back wall 42. The same technique is also used for the manner in which the right side wall 40 is joined to the walls 30 and 34.

According to the present invention, there are relatively few seams, since the entire box is composed of only two pieces of bent sheet metal—sheets 31 and 44.

FIG. 4 (taken along section line 4—4 of FIG. 1) shows in plan view how the door stop is stabilized and supported and how the door 22 is locked. Here, there is the single piece of metal which is folded, as on a bench press, to form the integrally connected walls 30, 32, 34 (FIG. 2), as well as the door frame 36 and the stop 38. As best seen in FIG. 2, the door frame 36 includes a vertical portion 36A joined by an upper horizontal portion 36B and a lower horizontal portion 36C, at upper and lower compound corner mitre joints X and Y, respectively. Similarly, the door stop 38 includes a vertical portion 38A joined by a pair of parallel, spaced apart upper and lower horizontal portions 38B and 38C.

Each one of the adjacent portions of the door frame portions and stop portions are integrally connected together as shown in FIG. 4. For example, the frame portion 36A extends inwardly and is integrally connected at its innermost portion to an outwardly facing door engageable stop portion 38A, which is bent inwardly and terminates in an inwardly extending distal end portion 39A (FIG. 4) of a distal end 39 extending along the three sides of the door opening. As best seen in FIG. 2, the distal end 39 includes a pair of upper horizontal portions (not shown) and a lower horizontal portion 39C joined by the vertical portion 39A.

Figure 3:
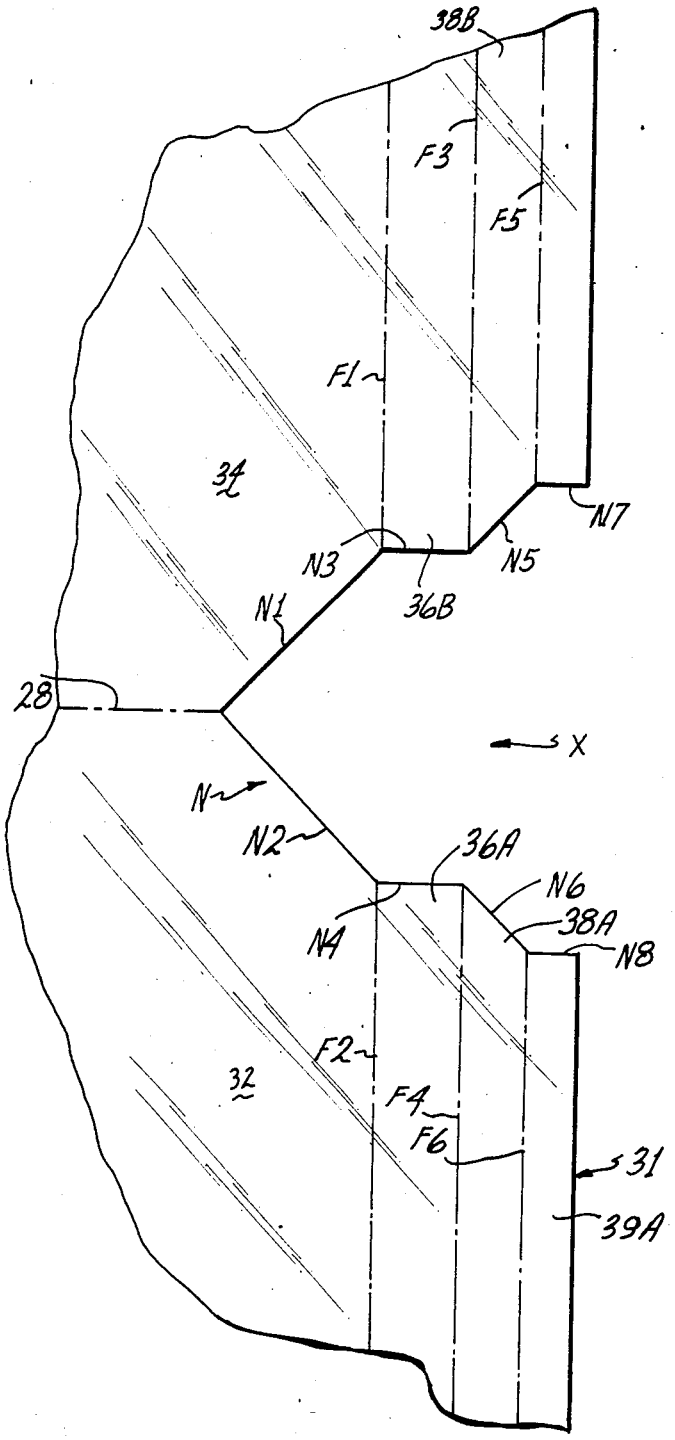
FIG. 3 is a fragmentary plan view of a sheet metal adapted to form one of the mitred corners of the box forming the safe.

Referring to FIG. 3, considering now the compound corner mitre X, it is understood that lower mitre Y is similar to the mitre X and thus requires no further description. The mitre X is formed of a single flat metal sheet 31, which is shown in FIG. 3, and which includes a large generally V-shaped notch N therein. The sheet 28 is folded about the line 28 to form the walls 34, the line 28 terminating at the notch N.

The notch N includes a pair of angularly-disposed edges N1 and N2 intersected at the line 28 and terminate at their outer ends at a pair of parallel, spaced-apart edges N3 and N4, respectively. The edges N3 and N4 terminate at their opposite ends at the respective angularly-disposed edges N5 and N6, which terminate at their opposite ends at a pair of parallel spaced-apart edges N7 and N8, respectively.

In order to form the mitre X, the sheet 31 is provided with outside bends at fold lines F1 and F2, inside bends at fold lines F3 and F4, and outside bends at F5 and F6. As a result, when the sheet is folded at the fold line 28, the corner mitre X is formed as shown in FIG. 2.

An elongated vertical bracing or filler piece or bar 46 is welded at 47 and 48 across the rearwardly open side of the door stop 38 to strengthen and stiffen both it and the frame 36. Therefore, if a pry is worked in between frame 36 and the door 22 (FIG. 1), it would be most difficult to bend the frame 36 or the stop 38 toward the panel 32, in an effort to open the door. Also, if someone pounds on the door with a heavy hammer or similar instrument, it would be most difficult to drive the door stop 38 back and into the safe far enough to gain access to the protected interior of the box 21.

The bar 46 includes a bent end portion 49 engaging the back side of the stop 38A and extending inwardly adjacent to the distal end 39A. The remaining portion of the bar 46 extends angularly rearwardly from the end portion 49 to the wall 32 to which it is welded at 48. The bar 46 is welded at 47 to the edge of the distal end 39. Like upper bar (not shown) and a lower bar 51 are connected similarly to the distal ends, such as the lower distal end 39C.

FIG. 4 shows in cross section, a vertical lip 50 integrally connected to the right wall or panel 40 which is disposed adjacent to the edge of the door 22 and in a plane therewith. Refer to the pictorial view of FIG. 2 for another view of the lip 50. More particularly, for reinforcing purposes, the lip 50 (lip means) of the sheet metal, of which the wall 40 is made, is reversely bent back upon itself at 52. An angle strip 54 of metal having an L-shaped cross section is positioned so that its long leg 54A lies flat against the inside surface of the panel 40 and its short leg 54B fits against the inside surface of the lip edge 50. The angle strip 54 is welded at 56 to the inside surface of the panel 40 and at 58 to the lip edge 50. This give strength and stability to the lip edge 50.

According to the present invention, as best seen in FIG. 4, should the hinge pins be removed from the hinge cylinders, the door 22 can not readily be removed from the box. Thus, the integrity of safe does not depend on the hinges.

For this purpose, the right hand side edge 22A of the door 22 is positioned in back of the lip 50 so that the right side, as well as all other sides, are prevented from moving outwardly. Also, the bolt 120, which extends through opening S in the bar 46, prevents the left side of the door 22 from being opened.

Figure 6:
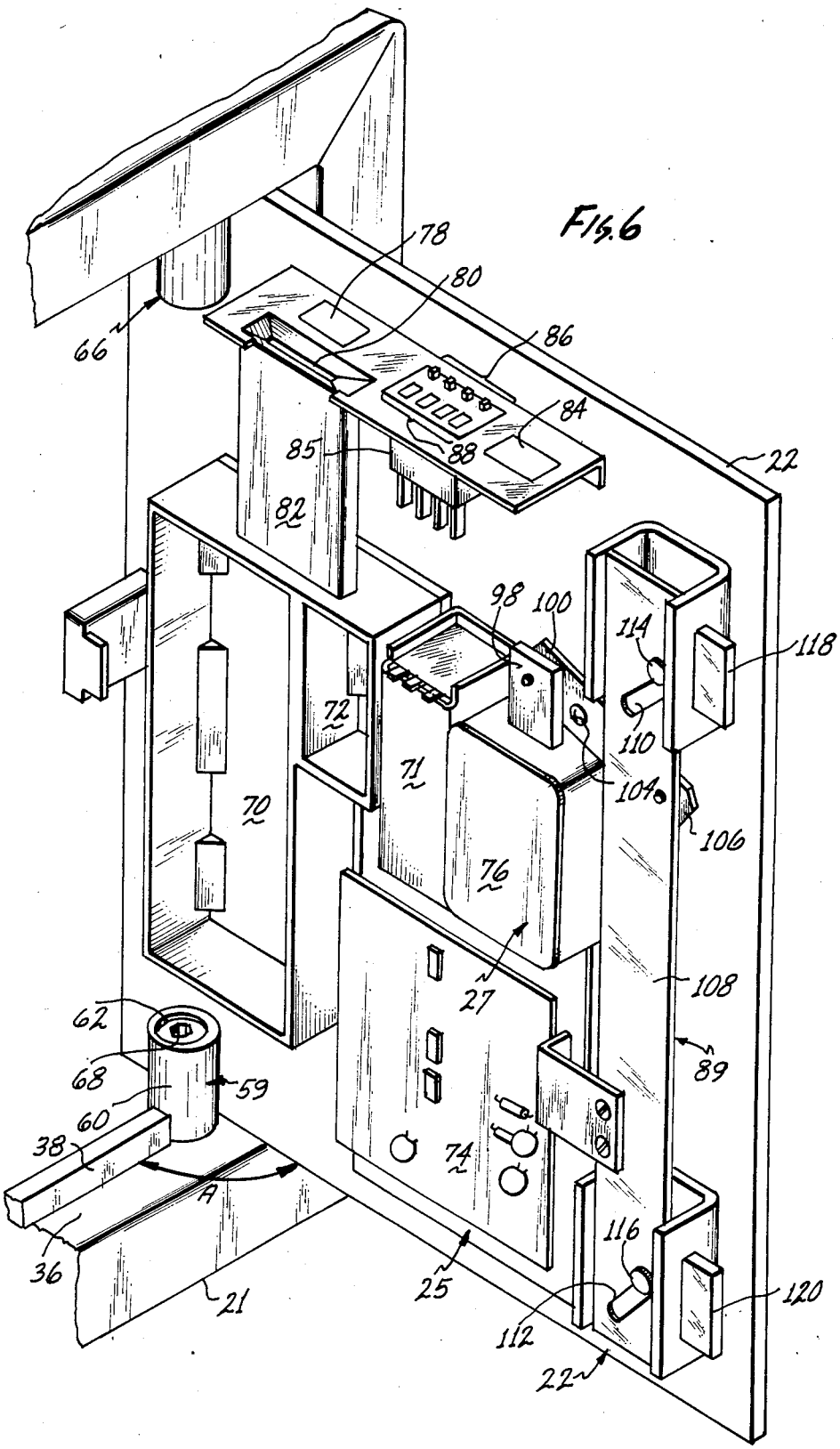
FIG. 6 is a back view of the door of the invention safe, the door being shown in its opened position with protective cover removed.
Figure 7:
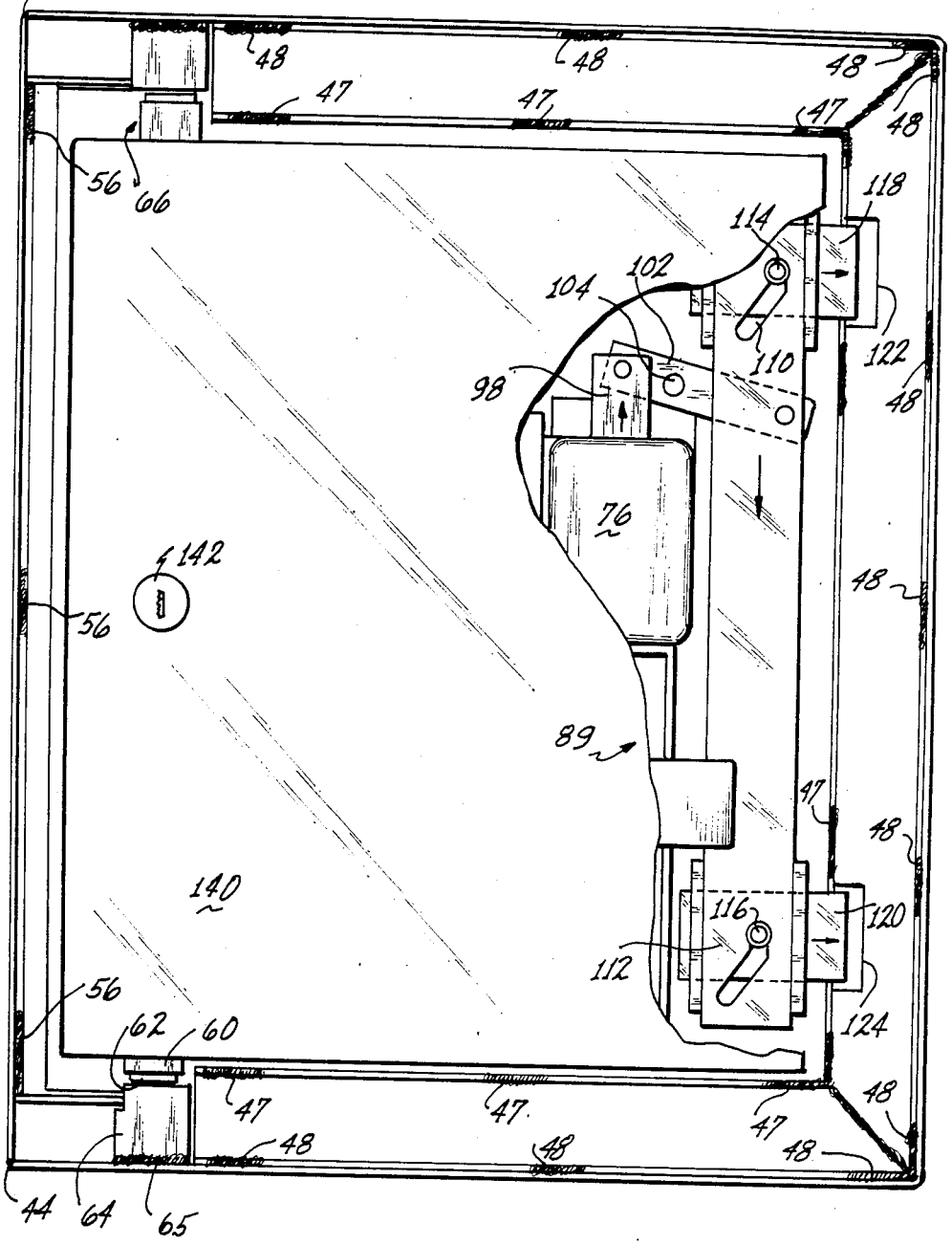
FIG. 7 is a fragmentary elevation view taken from the inside of the safe, looking toward the door when in its closed and locked position.

As seen in FIGS. 6 and 7, a pair of vertically aligned internal hinges 59 and 66 mount the right side of the door to the box 21. The hinge 59 includes a vertical cylinder 60 with a smooth bore. The cylinder is tubular in configuration and is welded to the door 22 in any suitable manner so that the door 22 and cylinder 60 move as a unit. A bolt or threaded rod 62 with a smooth section and a threaded section (shoulder bolt) passes through the bore of the cylinder 60 and is threaded into an underlying support 64 (FIG. 7), which is welded at 65 to the bottom of the safe. The smooth shaft portion of the rod 62 acts as a hinge pin about which the cylinder 60 rotates, and the head of the rod 62 is then recessed within the cylinder 60. A similar arrangement 66 is found at the top of the cabinet, in vertical alignment with cylinder 60.

As shown in FIG. 6, a hexhead bore or opening 68 is formed in the head of the hinge pin rod 62; therefore, when in this form, rod 62 may be installed or removed with the use of a simple conventional tool, such as a hex head Bondus tool (not shown). When the hinge pin rods are removed top and bottom, the entire door may be lifted out and replaced or repaired. Then, a new or repaired door is secured in place by returning the hinge pin rods 62 and tightening them into place.

All of the door locking mechanisms and controls therefor, are mounted entirely on the back of the door 22, and thus the entire door 22 can readily be removed from the box.

As indicated in FIG. 3 by a dot-dashed line 22, the hinges are inwardly and rearwardly offset relative to the reversely bent edge 52 of the lip 50 to enable the door to open to an angle A, which is substantially greater than 90 degrees. By so mounting, any access to both the contents of the safe and the back of the door is permitted. The angle A may vary with the design; however, it is thought that the various needs are best served when the angle A is between about 95 and 105 degrees, with the preferred angle of about 100 degrees.

The back of the door is shown in FIG. 6, with a cover (not shown) removed. The electronic circuits represented here are shown and decribed in U.S. patent application, Ser. No. 723,547, filed Apr. 15, 1985. However, the details of those circuits are not required for an understanding of this invention.

Suitable batteries (not shown) are placed in two housings 70 and 72 mounted on back of the door 22, for providing power for operating a solenoid 71 used to release the door in the electronic mode, as well as for powering the various electronic circuits (such as that represented by a printed circuit board 74 of the control circuit 25). The mechanical lock 27 is contained within a housing 76 on the back of the door 22, and the knob 26 on the front side of the door controls the lock 27 therefrom, as hereinafter described in greater detail. These features are explained with the help of FIGS. 8–13.

It is to be understood that the remainder of the components disposed on the back of the door 22, shown in FIG. 6, may be best understood from the description thereof in the foregoing copending patent application. However, a brief description will now be presented of such various components to facilitate a better understanding of the present invention. A display 78 instructs the user to insert an authorization card (not shown) into a slot 80, for guiding the card into a card reader 82 mounted on the upper rear portion of the door 22.

A display 84 then instructs the user to set a personal access code into a non-volatile memory 85. To do this, the user pushes the buttons 86 any suitable number of times and responsive to each push, a code appears at a display 88. For example, each push of a button may increment a display of the ten digits 0–9, which continue to cycle endlessly, as long as the associated button continues to be pushed.

Figure 8:
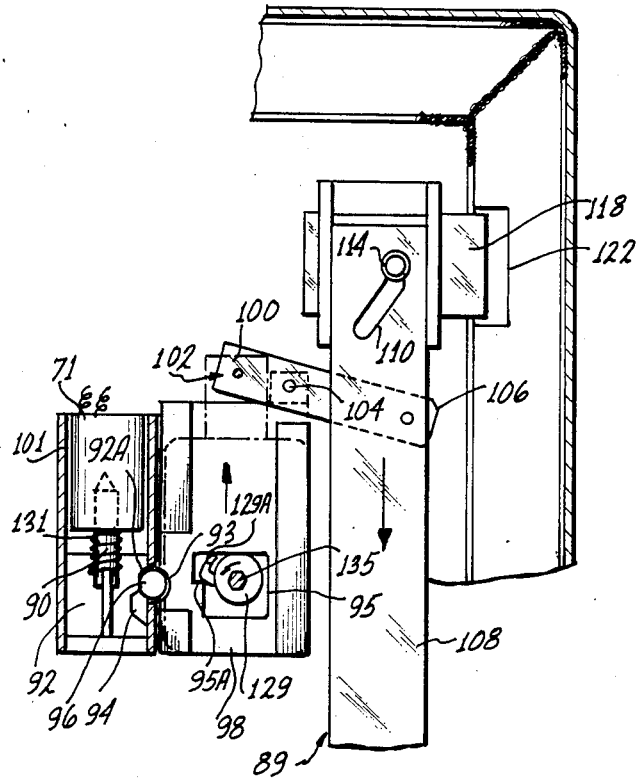
FIG. 8 is a fragmentary elevational view of the upper righthand corner of FIG. 7, showing the safe in a locked condition.
Figure 9:
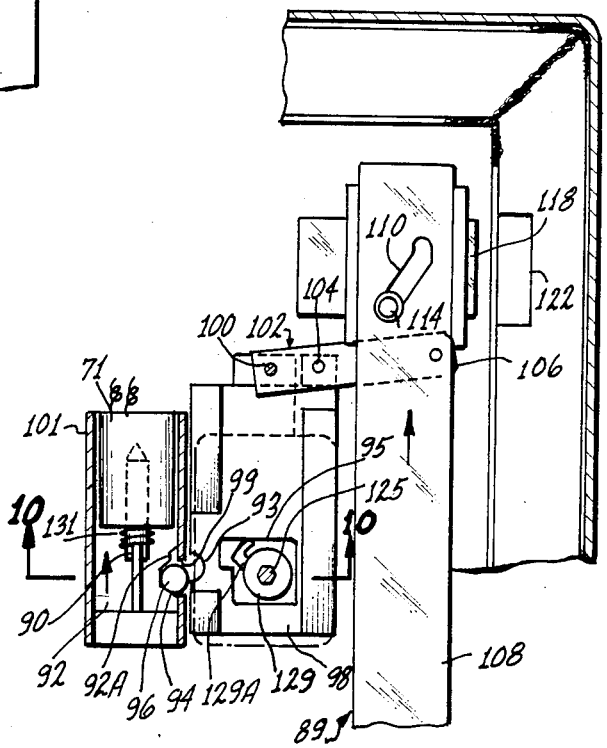
FIG. 9 is a similar fragmentary view as FIG. 8, showing the safe in an unlocked condition.

Considering the electronic control mode of operation, the solenoid 71 is actuated under the control of the circuit 25 for releasing a bolt-works latching mechanism generally indicated at 89. As shown in FIGS. 8 and 9, the solenoid 71 includes a plunger 90, which retracts for sliding a bar 92 upwardly against the opposition of a spring 131. In the locked position (FIG. 8), a roller or pin 96 is disposed in an opening 99 in the right side of a solenoid housing 101, and extends between a small notch or cove 92A in the right side of the bar 92 and a small keeper notch 93 in an adjacent reciprocatively slidable bar 98, to prevent the bar 98 from moving up or down, thereby preventing the knob 26 from moving the latching mechanism 89. Bar 92 also contains in the right side thereof, a large notch or cove 94 which communicates with the small notch 92A and which receives the pin 96 in the retracted position of bar 92 (FIG. 9). As the knob 26 is rotated manually, the pin 96 moves to the left from the locked position (FIG. 8) to the unlocked position (FIG. 9), whereby the pin 96 disengages the smaller keeper notch 93 in an adjacent reciprocatively slidable bar 98, and enters the large notch 94. The bar 98 is thus free to also move up responsive to the rotation of knob 26, thereby releasing the latching mechanism 89.

In operation, once the solenoid 71 is actuated to retract the bar 92 to the position of FIG. 9 with the large notch 94 opposite the opening 99, the user rotates knob 26 (FIG. 1) to its "open" position (FIG. 9), to raise the slide bar 98, thereby pushing or camming the pin 96 leftwardly out of the keeper notch 93 through the side opening 99 in the solenoid housing 101 and into the large notch 94. Thus, the slide bar 98 is then free to move upwardly, since pin 96 is no longer in the keeper notch 93 and bar 98.

Figure 11:
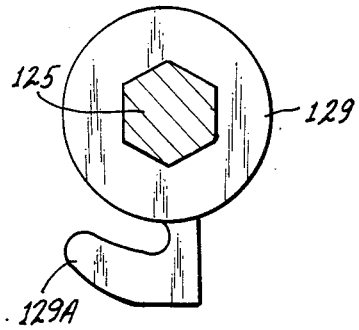
FIG. 11 is an enlarged view of a shaft and a cam part taken substantially on line 11—11 of FIG. 10.
Figure 12:
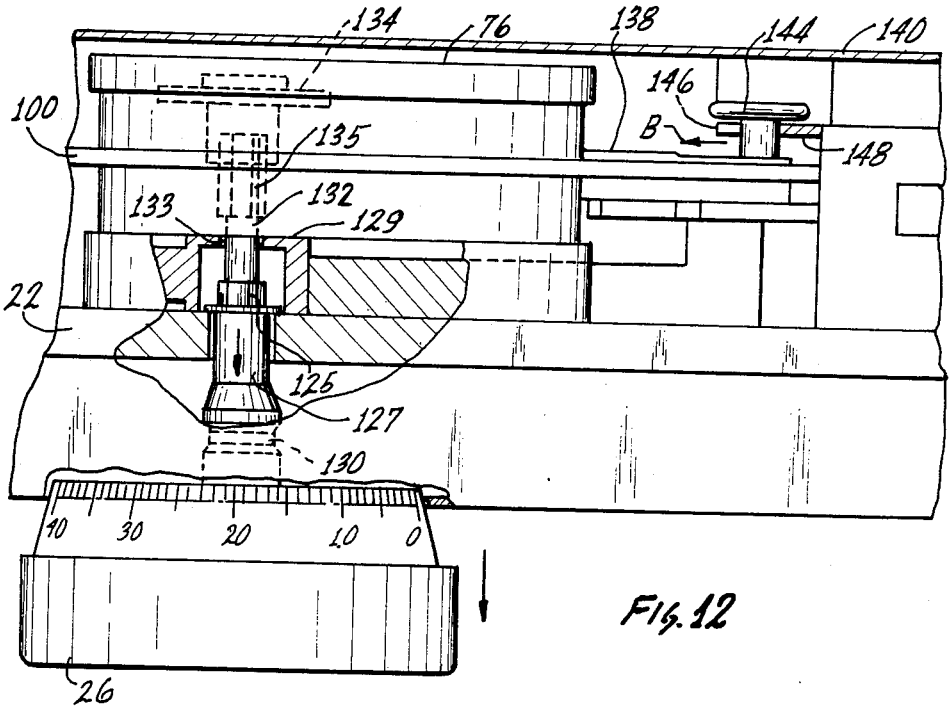
FIG. 12 is a sectional view, similar to the view of FIG. 10, but showing the mechanical, combination lock in a mechanical lock enabled position.

More particularly, the knob 26 is normally held in a recessed position (FIG. 10) by a set screw 126 (FIGS. 1 and 12). In this position, a spline 125 on a shaft 125 engages rotary part 129 having a hexagonally shaped central opening for receiving nonrotatably slidably the spine 127, which is hexagonal in cross section throughout its length. Therefore, cam part 129 turns with the knob 26. As best seen in FIGS. 8, 9 and 11, the rotary part 129 has a cam foot 129A which cooperates with a cam follower opening 95 (FIGS. 8 and 9) in bar 98 to slide the bar up and down. As best seen in FIG. 9, when the knob 26 turns to "open" and the cam part 129 rotates in a clockwise direction of the curved arrow, an end 100 (FIG. 9) of a link 102 remains stationary, and the link 102 pivots about the point 100, since the bar 98 is pivotally attached to the link 102 at 104 intermediate the ends thereof. In this regard, the foot 129A bears against the edge of the opening 95 to slide the bar 98 upwardly into the position, as shown in FIG. 9. In so doing, both an end 106 and a vertically sliding link or bar 108 of the latching mechanism 89 are raised upwardly. Formed in bar 108 are upper and lower diagonal elongated key way slots 110 and 112 which include pins 114 and 116, embedded in latch bars 118 and 120 which, therefore, slide to the left (as viewed in FIGS. 7 and 9) as the bar 108 moves upwardly. As the pins 114 and 116 move to the left, latch bars 118 and 120 leave keepers 122 and 124 in the door stop to release the door.

As best seen in FIG. 8, when the knob 26 is rotated to its "lock" position, the foot 129A of the cam part 129 rotates in a counterclockwise direction of the curved arrow to engage an enlarged portion 95A of the cam follower opening 95, and thus slide the bar 98 downwardly into the position as shown in FIG. 8. In this manner, the bar 98 is pushed downwardly into the position as illustrated in FIG. 8. The link 102 pivots about the point 100, which lowers the link end 106 and the bar 108, together with its diagonal slots 110 and 112. Thus, the pins 114 and 116 and latch bars 118 and 120 slide to the right (as viewed in FIGS. 7 and 8), to enter the keepers 122 and 124 in the door stop and lock the door 22.

As shown in FIGS. 8 and 9, the rotation of the knob 26 to "lock" when the solenoid 71 is de-energized, a spring 131 pushes the bar 92 downwardly, and the pin 96 then is cammed out of the large notch 94 and back into the keeper notch 93, thereby effectively joining the bars 92 and 98 to prevent the unlocking of the safe until the correct digital code is next entered on key pad 24.

Next, assume that a properly authorized person, such as personnel of the hotel or motel, wants to open the safe. For example, if the guest vacates the room with the safe door locked, or if the user forgets the digital code for the electrical locking arrangement, the authorized personnel can release the door independently of the electronic lock.

Normally, the knob 26 is held in a recessed position which inhibits use of the mechanical combination lock. When the knob is so recessed, (FIG. 10), it can be rotated manually to open or lock the door under the control of the electronic lock control circuit 25 and the solenoid 71, but the combination scale 128 is concealed from view so that the knob may not be used with the mechanical lock 27 to release the door.

To enable a use of the combination lock, an authorized person, who knows the correct combination of the mechanical lock, loosens a set screw 126 (shown in solid lines in FIG. 1, and in phantom lines in FIG. 10) on the underside of the knob 26. The set screw may be constructed to require a special tool before it can be retracted.

When the set screw is backed away from a circumferential groove 130 in the shaft 127, the knob 26 can be pulled out of its recessed position and is extended to an axial position where the scale 128 is exposed to view and the knob may be operated in the manner of a conventional combination lock dial. As the knob 26 moves out of its recess, a shaft 132, forming a rearward extension of the hex-shaped spline 125, also slides outwardly, and the spline 125 moves out of a complementary shaped hexagonal hole 133 (FIG. 12) of the cam part 129, so that it no longer rotates with the knob. This further disables the solenoid controlled electrical door releasing arrangement of the present invention.

An elongated splined part 135 forming a rearward distal end of the shaft 132, is hexagonal in cross-section throughout its length and slides within a cam part 134, which continues to rotate with the shaft 132 and the knob 26. In this mode of operation, rotation of the knob 26 causes the various conventional rotatable combination lock parts or elements generally indicated at 27A (FIG. 13) of the combination lock 27, in an attempt to enter the correct combination of digits as indicated on the scale 128 (FIG. 12).

Figure 13:
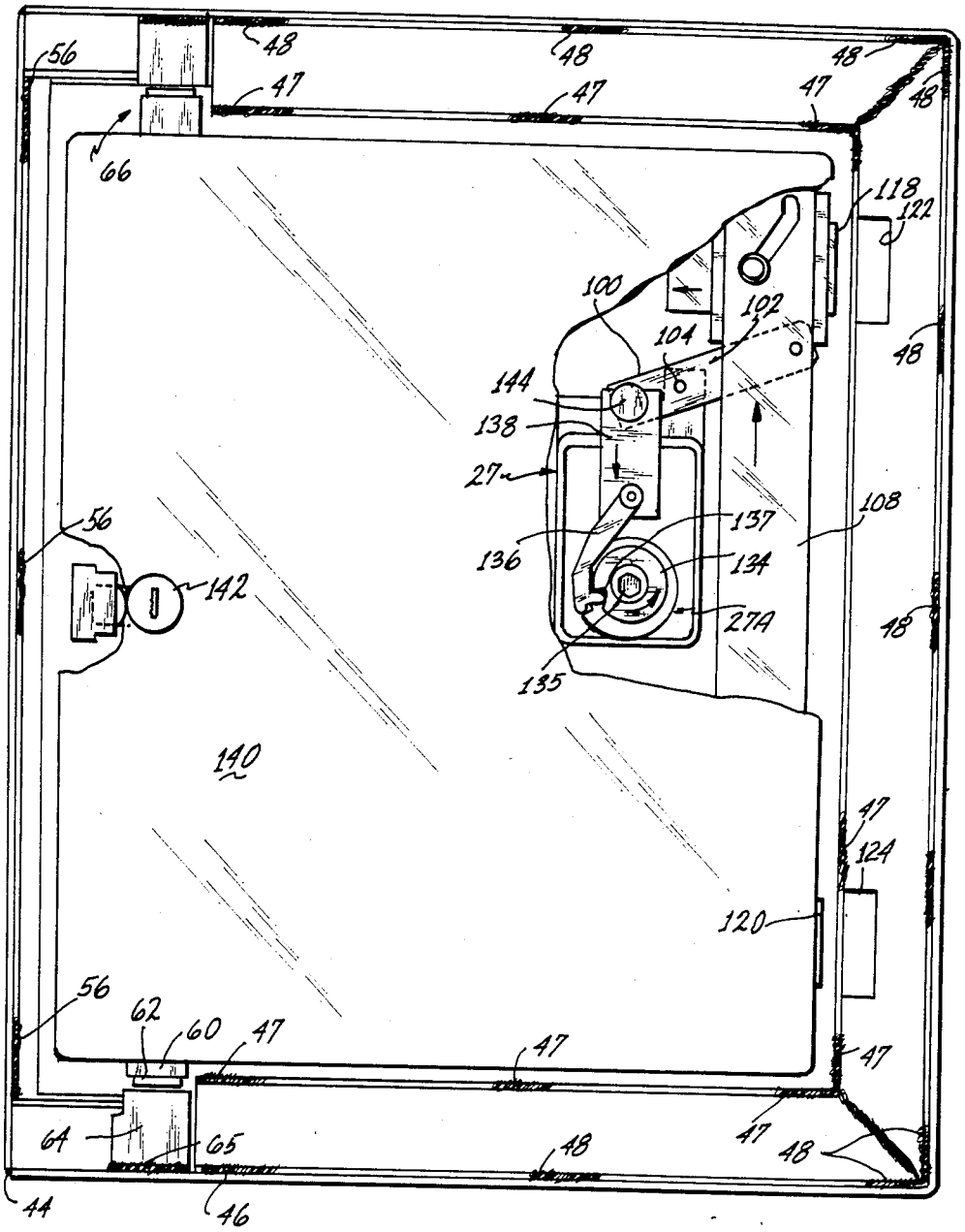
FIG. 13 is a view of the back of the door, similar to the view of FIG. 7, but showing how the mechanical combination lock controls the safe.

The successful operation of the combination lock 27 by manipulation of the knob 26, causes the rotation of the shaft 132 and its splined end 135 and cam 134, and as a final result of the successful operation, a latch hook 136 catches in a peripheral notch 137 in cam 134 (FIG. 13). Responsive thereto, a vertical link 138 is pulled downwardly in the direction of the arrow, to pivot link 102 about point 104 and raise the vertically sliding bar 108 to the position as shown in FIG. 13, thus unlatching the door.

It should be noted that when the mechanical lock 27 is used to release the door, the link 102 is caused to pivot about the point 104. However, when the electronic control circuit 25 is used to release the door, the link 102 is caused to be pivoted about a large headed rivet 144 (FIG. 13) at the end 100 of the link 102. In either mode of operation (mechanical or electrical), the same link 102 is used to release the door. Points 100 and 104 are used alternately as pivotal or driven points for the respective mechanical and electrical modes of operation.

After the door, is released by the combination lock, and then closed, the knob 26 (FIG. 1) is turned to the lock position and the latch hook 136 disengages the notch 137 in cam 134. The knob is then pushed back into the recessed position. Set screw 126 is tightened into groove 130 (FIG. 10), to hold it in position.

A panel 140 (FIGS. 7, 13) covers all of the equipment mounted on the back of the door, except for displays 78, 84, 88 (FIG. 6), card slot 80, and the code setting push buttons 86. It should be noted that panel 140 covers the hinges 62 and 66 so that they cannot be removed with panel 140 in place.

If repair or maintenance is required, the back cover panel 140 (FIG. 13) is removed, but only with the aid of a key lock 142 (FIG. 13), and a special procedure which is followed after the operation of the knob 26. In greater detail, when the mechanical, combination lock is operated, the link 102 (FIGS. 9, 12 and 13) is pulled down to cause the rivet 144 to move downwardly as well. This rivet 144 moves in the direction of arrow B (FIG. 12) to clear a slot 146 in a bracket 148 affixed to the back of cover 140. Thus, the cover 140 cannot be removed unless it is first unlocked by both a key and the operation of the mechanical combination lock. Therefore, the casual user cannot normally remove the panel 140.

Once cover 140 is removed, the hinges 60 and 66 are accessible. Using a Bondus tool or other suitable and special tool, the hinge pin 62 (FIG. 6) and its counterpart at 66 are removed, by unscrewing them. Then, the door requiring maintenance or repair is lifted out and a different and fully operative door is substituted. The hinge pins and cover plate 140 are replaced. The defective door is taken away for maintenance or repair.

Figure 14:
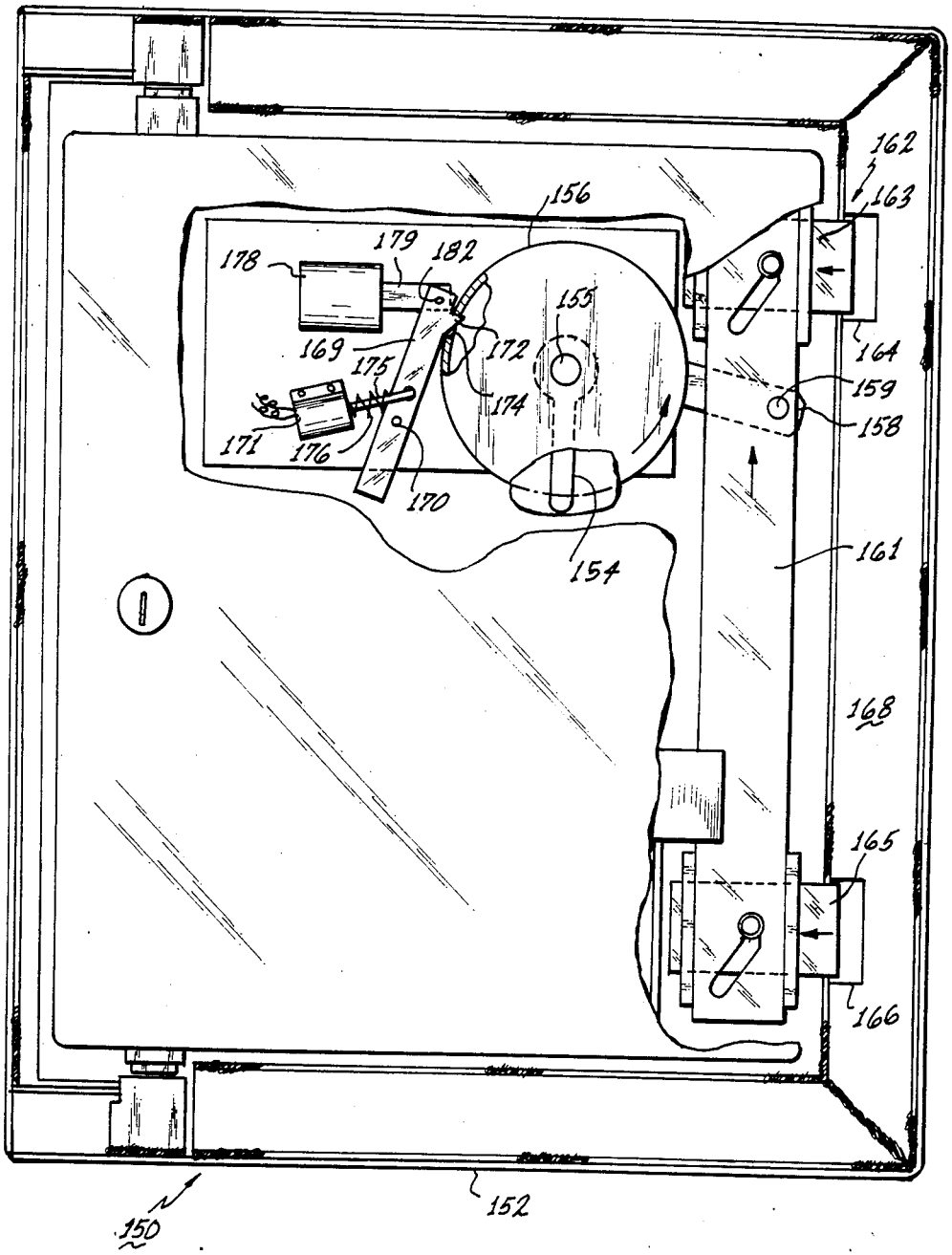
FIG. 14 is a fragmentary elevational view of the back of a door of another safe, which is also constructed in accordance with the present invention.

Referring now to FIG. 14, there is shown another safe 150, which is constructed in accordance with the present invention. The safe 150 is generally similar to the safe 20, except that the manner and arrangement of the interconnection between the mechanical and electronic locks is somewhat different.

The safe 150 includes a door 152, which is generally similar to the door 22 of FIG. 1. A handle 154 is pivotally mounted at 155 to the front side of the door 152 for facilitating the releasing of it. A circular drum 156 is rotatably mounted on the back side of the door and rotates with the handle 154, about the central axis 155, to move an arm 158, which is pivotally attached at 159 to a vertically movable bar 161 to operate a bolt-works mechanism 162. The handle 154 is connected through an opening (not shown) in the door, either directly or indirectly to the drum 156.

The mechanism includes a pair of bolts 163 and 165, which move into and out of a pair of recesses or openings 164 and 166 respectively, in a door frame 168. The mechanism 162 is constructed similarly to the one shown and described in connection with the safe 20.

In order to lock the safe door 152, an arm 169 is pivotally mounted to the back side of the door 170, and has an ear 172, which is normally positioned within a slot or opening 174 in the side wall of the drum, to prevent it from rotating, thereby preventing the handle 154 from releasing the door. An electronic circuit (not shown), which is similar to the control circuit 25 for the safe 20, causes the operation of a solenoid 171, when the correct access code is entered into a key pad (not shown) on the front side of the door 152. In so doing, a rod or plunger 175 is retracted against the force of a spring 176 to pivot the arm 169 in a counter-clockwise direction as viewed in FIG. 14, to withdraw the ear 172 from the opening 174, thereby permitting the door to be unlatched by manual rotation of the handle 154. Once the door is to be relocked, the solenoid 171 is de-energized to permit the spring 176 to urge the arm 169 in a clockwise direction, as viewed in FIG. 14, until the ear 172 enters the opening 174 to lock the door.

Alternatively, the door 152 may be released mechanically by dialing a correct access code into a mechanical lock 178, which is mounted on the back side of the door and is controlled from the front of the door by means, not shown. In this regard, a separate dial or knob (not shown) may be mounted on the front side of the door, and has a shank portion or shaft (not shown) which extends through a suitable opening (not shown) in the door, to the lock 178. The knob may be removed from the door during its normal use, until one desires to open the door mechanically. The shaft of the knob is then inserted through the door opening and into the mechanical lock for enabling it to be actuated.

If the correct combination is entered in the mechanical combination lock 178, a slidable member 179 retracts leftwardly to cause the arm 169 to pivot in a counter-clockwise direction, as viewed in FIG. 14, about the pivot point 170. In this regard, the distal end portion of the member 179 is pivotally attached at 182 to the upper end of the arm 169. Thus, once the proper combination is entered into the lock 178, the arm 169 pivots backwardly to withdraw the ear 172 from the opening 174 to permit the door to be opened. When the door is to be relocked, the combination can be adjusted to cause the member 179 to release the arm 169, thereby causing the spring 176 to return the arm 169 to its locking position as shown in FIG. 14.

Those who are skilled in the art will readily perceive many modifications which may be made within the spirit and the scope of the invention. For example, different types and kinds of materials may be employed for the walls of the safe. Therefore, the appended claims are to be construed to cover all equivalents which fall within the true scope and spirit of the invention.

We claim:

1. A safe comprising:

a first single sheet composed of metal material and folded along a spaced apart pair of substantially parallel lines in a generally U-shaped configuration, forming a bottom wall, a top wall and a side wall;

a second single sheet composed of metal material and folded along a single line in a generally L-shaped configuration, forming a back wall and a side wall:

means defining four seams joining contiguous walls of said first and second sheets together fixedly at their marginal edges forming a hollow five-sided box having a front door opening;

a door mounted at side door opening to swing between opened and closed positions;

means for stabilizing and strengthening the door and connected to said first and second sheet said box for connecting said door on said box pivotally over said opening in said closed position, whereby said hinge is concealed and inaccessible when said door is in its closed position; and locking means for locking and unlocking said door.

2. The safe of claim 1, wherein said door means includes lip means for cooperating with said door means for preventing said door means from being opened should said hinge means become disassembled or damaged.

3. The safe of claim 1, wherein substantially all of said single locking means and said user controlled means are mounted on said door means, so that said door means can be opened and then removed as a unit from said box in a convenient manner, by disassembling said hinge means, for repair or maintenance purposes.

4. The safe of claim 1, wherein said means for stabilizing and strengthening said edges includes folds along edges of said one piece of sheet metal to form a door frame and stop extending along three sides of said open and exposed edges surrounding at least a portion of said door opening, for receiving said door.

5. The safe of claim 2, wherein said means for stabilizing and strengthening said edges include filler pieces positioned inside said box to brace both said frame and stop at each of said open and exposed edges, each of said filler pieces being fixedly connected to said stop and to an adjacent one of the three sides along which the door frame and stop extends.

6. The safe of claim 1, wherein said hinge includes a pair of members secured in vertical axial alignment at inside top and bottom edges of said door, each of said members having an axial bore, and hinge pins having shafts extending through said members and being threaded into an underlying support on said box.

7. The safe of claim 6, wherein said pair of members includes a pair of cylinders, said pair of cylinders are displaced from an edge of said door which is parallel to said alignment, and said displacement is by a distance which enables said door to swing to an open position between approximately 95 degrees and 105 degrees displaced from a closed position of said door.

8. The safe of claim 1, further comprising:

at least two separate and independent user controlled means for controlling said single locking means;

wherein said two separate and independent user controlled means comprise an electronic lock controlled by a key pad for entering a digital code and a combination mechanical lock.

9. The safe of claim 8, and means disposed on the outside of said safe for enabling said mechanical lock to release said door.

10. A safe comprising:

a box having a door mounted thereon to swing between opened and closed positions;

latch means fixed on the door for securing said door to the box when the door is in a closed position, said latch means including a common link for operating the latch means;

means associated with the door for entering a code in an electronic control circuit for operating said latch means to release said door;

a mechanical lock means;

a manually movable member associated with said door for entering a code in said mechanical lock means for operating said latch means to release said door;

solenoid means responsive to said control circuit for operating said latch means, said solenoid means including means connected to said common link for moving said common link to cause said latch means to release said door; and said mechanical lock means including means connected to said common link for moving said link alternatively to release said door.

11. The safe of claim 10, wherein said latch means includes door releasing means, said link is connected actuatively to said door releasing means, said solenoid means is connected pivotally at a first pivot point to said common link, said connecting means of said mechanical lock means is pivotally connected to said common link at a second pivot point, and said first and second pivot points are spaced apart by a substantial distance, so that when said solenoid means moves said link, it pivots about said second pivot point, and when said mechanical lock moves said link, it pivots about said first pivot point, whereby said solenoid means and said mechanical lock means can release said door independently of one another.

12. The safe of claim 11, wherein a rotatable member is driven manually by the rotation of said manually movable member, said rotatable member includes an opening therein, and said link includes an ear for engaging said opening to prevent it from being engaged, whereby said mechanical lock means or said solenoid means can move said link alternatively to retract said ear from said opening to free said rotatable member for releasing said door.

13. The safe of claim 11, wherein said latch means includes a reciprocatively mounted slide member, pivotally connected at said first pivot point to said common link, said slide member includes a keeper notch, a pin enters said keeper notch to prevent said slide member from moving said common link, and said solenoid means responds to said control circuit for causing said pin to be retracted from said keeper notch to permit said slide to be moved, thereby permitting said common link to be moved for releasing said door.

14. The safe of claim 13 and hinge means attached to the back of said door whereby access may be had to said hinge means only while said door is opened, and removable means for enabling said hinge to release said door from said safe so that equipment mounted on said door may be serviced by substituting a door with another door with inoperative equipment.

15. The safe of claim 14 and a cover mounted on the back side of said door over said latch means and said removable means, and cover lock means securing lockably the cover in place for protection purposes.

16. The safe of claim 13, wherein said solenoid means includes a housing having a side opening therein disposed adjacent to said slide bar, a reciprocatively movable member in said housing moving when said solenoid is energized and has notch means disposed opposite said side opening when said solenoid means is energized to permit said pin to move into said large notch to free said slide bar for permitting it to move said common link.

17. The safe of claim 16, wherein said manually movable member is connected to said slide bar to move it, after being freed from said pin.

18. The safe of claim 17, wherein said movable member includes cam means and said slide bar includes a cam follower means for cooperating to translate rotary motion of said movable member to rectilinear motion of said slide bar.

19. The safe of claim 18, wherein said connecting means of said lock means includes a cam member having a notch therein and is connected through rotatable locking elements to said movable member, a latch hook engages the cam member notch, and is coupled to said second pivot point on said common link to cause it to pivot when the correct code is entered in the mechanical lock.

20. The safe of claim 19, wherein said means for entering said code and said mechanical means are mounted on the front of said door, and means on the back of said door to change said code, whereby said code can only be changed with said door open.

21. A safe comprising:

a box having a door mounted thereon to swing between opened and closed positions;

latch means fixed on one side of the door for securing said door to the box when the door is in a closed position;

a pair of spaced apart, axially aligned tubular hinge cylinders fixedly mounted on the other side of said door and disposed on the inside of the box when the door is disposed in its closed position;

a pair of removable hinge pin devices positioned within said cylinders, each one of the hinge pin devices being bolt-like devices connected threadably to a respective one of a floor and a ceiling of said box; and reinforced lip means on said box near said other side of said door extending adjacent to a portion of the front face of the door to inhibit the removal of the door should the pin devices be removed from their cylinders when the door is latched and disposed in its closed position;

whereby said hinge cylinders and hinge pin devices are disposed on the protected side of the door, and when the door is disposed in its opened position, the pin devices can be removed to permit the door to be removed from the box for servicing purposes.

22. The safe of claim 21, wherein said lip means includes an edge reversely folded back upon itself at the hinged side of said door, and an angle member strengthening an interior corner of said box at said fold back.

* * * * *

UNITED STATES PATENT AND TRADEMARK OFFICE

CERTIFICATE OF CORRECTION

PATENT NO. : 4,669,394

DATED : June 2, 1987

INVENTOR(S) : H. Frank Fogleman

It is certified that error appears in the above-identified patent and that said Letters Patent are hereby corrected as shown below:

Column 10, Line 41; "side" should read --said--.

Column 10, Line 43; "means for stabilizing and strengthening the door and connected to said first and second sheet said box for" sould read --means connected to said first and second sheets for stabilizing and strengthening the door and exposed edges of said five-sided box; hinge means disposed inside said box for--.

Signed and Sealed this

Twenty-second Day of September, 1987

*Attest:*

DONALD J. QUIGG

*Attesting Officer* *Commissioner of Patents and Trademarks*